US008678139B2

(12) United States Patent
Aulanko et al.

(10) Patent No.: US 8,678,139 B2
(45) **Date of Patent: *Mar. 25, 2014**

(54) METAL ROPE, ELEVATOR PROVIDED WITH METAL ROPE, AND USE OF LUBRICANT FOR LUBRICATING THE METAL ROPE

(75) Inventors: Esko Aulanko, Kerava (FI); Raimo Pelto-Huikko, Vantaa (FI); Sakari Korvenranta, Hyvinkää (FI); Jarmo Myllynen, Hyvinkää (FI); Pekka Torenius, Röykkä (FI)

(73) Assignee: Kone Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/301,144

(22) Filed: Nov. 21, 2011

(65) Prior Publication Data

US 2012/0061188 A1 Mar. 15, 2012

Related U.S. Application Data

(63) Continuation of application No. PCT/FI2010/050406, filed on May 20, 2010.

(30) Foreign Application Priority Data

May 20, 2009 (FI) ..... 20090202

(51) Int. Cl.
*B66B 11/08* (2006.01)

(52) U.S. Cl.
USPC ..... 187/254; 187/251; 428/68; 428/76

(58) Field of Classification Search
USPC ..... 187/254, 251
See application file for complete search history.

(56) References Cited

U.S. PATENT DOCUMENTS

| | | | |
|---|---|---|---|
| 2,028,157 | A | 1/1936 | Hodson |
| 3,838,752 | A | 10/1974 | Sivik et al. |

(Continued)

FOREIGN PATENT DOCUMENTS

| | | | |
|---|---|---|---|
| EP | 0359466 | A1 | 3/1990 |
| EP | 1273695 | A1 | 1/2003 |
| JP | 2006182856 | A | 7/2006 |

OTHER PUBLICATIONS

International Search Report PCT/ISA/210 for International Application No. PCT/FI2011/050456 dated Aug. 19, 2011.

(Continued)

*Primary Examiner* — Brent O'Hern
(74) *Attorney, Agent, or Firm* — Harness, Dickey & Pierce, P.L.C.

(57) ABSTRACT

The object of the invention is a traction sheave elevator and a rope (3) that contains metal as a load-bearing material, such as the suspension rope of an elevator, which rope comprises at least one or more strands (7) laid from metal wires (9) and which rope (3) is lubricated with a lubricant (8). Another object is the use of the aforementioned lubricant for lubricating the rope (3). The lubricant (8) comprises at least oil and thickener, which thickener in the lubricant (8) comprises at least 10% or more of the mass of the lubricant (8).

13 Claims, 3 Drawing Sheets

(56) References Cited

U.S. PATENT DOCUMENTS

| | | | | |
|---|---|---|---|---|
| 5,116,522 | A * | 5/1992 | Brown et al. | 508/473 |
| 6,010,984 | A | 1/2000 | Heimann et al. | |
| 6,010,985 | A | 1/2000 | Heimann et al. | |
| 6,017,857 | A | 1/2000 | Heimann et al. | |
| 6,316,392 | B1 | 11/2001 | Heimann et al. | |
| 6,327,841 | B1 | 12/2001 | Bertini et al. | |
| 6,331,509 | B1 | 12/2001 | Heimann et al. | |
| 6,418,704 | B2 | 7/2002 | Bertini et al. | |
| 2002/0050131 | A1 | 5/2002 | Bertini et al. | |
| 2002/0095929 | A1 | 7/2002 | Bertini et al. | |
| 2002/0098989 | A1 | 7/2002 | Heimann et al. | |
| 2003/0089551 | A1 * | 5/2003 | Kato et al. | 182/1 |
| 2004/0083706 | A1 | 5/2004 | Eichhorn | |
| 2004/0254080 | A1 | 12/2004 | Sivik et al. | |

OTHER PUBLICATIONS

Written Opinion of the International Searching Authority PCT/ISA/237 for International Application No. PCT/FI2011/050456 dated Aug. 19, 2011.

* cited by examiner

METAL ROPE, ELEVATOR PROVIDED WITH METAL ROPE, AND USE OF LUBRICANT FOR LUBRICATING THE METAL ROPE

CROSS-REFERENCE TO RELATED APPLICATIONS

This application is a continuation of PCT/FI2010/050406 filed on May 20, 2010, which is an international application claiming priority from FI 20090202 filed on May 20, 2009, the entire contents of which are hereby incorporated by reference.

BACKGROUND

The object of the invention is a metal rope, an elevator provided with the metal rope and the use of the lubricant for lubricating the metal rope.

Ropes laid from metal wires, more particularly the hoisting ropes, i.e. suspension ropes, of elevators or other hoisting apparatuses are generally lubricated with some suitable lubricant. Lubrication improves the operation of ropes and reduces the wearing of the ropes, in which case the service life of the ropes lengthens. Lubrication also prevents the rusting of ropes. Ropes are usually lubricated in connection with the manufacture of the ropes, e.g. such that lubricant is sprayed into the strand to be manufactured when laying the strands of ropes from steel wires.

According to one prior-art technique, the lubricant used is paraffin-based. A problem when using paraffin is, however, when the ropes get hot the structure of the oil thins, in which case the oil bound by the paraffin can easily detach from the rope. Another problem with paraffin-based lubricant is that the traction sheave-rope contact becomes more slippery at a higher temperature, due to which it can be difficult to get the friction factor between the traction sheave and the rope to meet the values required by elevator regulations. If the friction factor is too small, the ropes can slip on the traction sheave, which causes problems and can also be a safety risk. Other relatively thin lubricants have the same type of problems as oil mixed with paraffin.

Normally it is desired to make elevators and elevator structures as light as possible, in which case the elevator would be cheaper to manufacture and install. As the elevator car and the counterweight become lighter, however, the friction between the elevator ropes and the traction sheave decreases at the same time. The reduction in friction thus limits the making of lighter elevators; a general aim is to achieve high friction but, however, such that the ropes do not wear too quickly.

SUMMARY

The idea of this invention is to equip an elevator with the type of elevator ropes in which lubricant containing solid additives is used as a lubricant instead of oil, paraffin or oil mixed with paraffin, resulting from which the friction between the elevator ropes and the traction sheave will be greater than with elevator ropes that are lubricated according to prior art.

The aim of this invention is to eliminate the aforementioned drawbacks and to achieve a metal rope, e.g. a suspension rope of a traction sheave elevator, that is lubricated with a lubricating grease type of lubricant, the friction factor between which suspension rope and traction sheave is greater than existing solutions. In addition, one aim is to achieve a suspension rope of a traction sheave elevator, the service life of which suspension rope is longer than before. Yet another aim is to achieve a suspension rope of a traction sheave elevator in which the lubricant stays on the rope well during the operation of the rope. The aim of the invention is also to achieve a traction sheave elevator, in which the suspension ropes are lubricated with a lubricating grease type of lubricant. Additionally the aim of the invention is to achieve the use of a lubricating grease type of lubricant for lubricating a metal rope, such as the suspension rope of an elevator.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition it can be stated that at least some of the subordinate claims can at least in suitable situations be deemed to be inventive in their own right.

One advantage, among others, of the solution according to the invention is that the friction between the elevator ropes and the rope grooves of the traction sheave is greater than with conventional oil-lubricated elevator ropes. Another advantage is that, as a result of the better frictive traction, the slip control of the elevator ropes on the traction sheave also improves. From the advantages presented above follows the advantage that the torque of the motor can be utilized more efficiently, as the ratio of the rope forces on different sides of the traction sheave can be made to be greater, which enables an improvement of the ratio of the net useful load and the deadweight of the car. A further advantage is that the greater friction allows a smaller diameter of the traction sheave, or correspondingly a smaller contact angle of the elevator ropes and the traction sheave. One advantage is also that, owing to the better frictive traction, smaller and lighter structures can be used in the elevator, which also results in a reduction of costs. An additional advantage is that the elevator rope does not rust or wear easily, so consequently the lifetime of the rope is longer compared e.g. to a rope lubricated with paraffin. Another advantage is that the lubricant penetrates inside the rope very well and stays attached to the rope well, and does not detach from it easily or splash into other parts of the elevator.

An essential aspect of the invention is to lubricate metal ropes, in practice steel ropes, which possibly contain non-metal parts, with a lubricant that comprises at least oil and thickener. The thickener in the lubricant comprises at least 10% of its mass. Depending on the thickener and on the additives, thickener content levels of 10-20% already produce a rather dry lubricant. If the thickener comprises at least approx. one-third, binding of the oil to the lubricant is rather easy. In practice, the percentage content of thickener must be kept below 90%, preferably below 85%, for sufficient lubricating oil to be bound to the lubricant. Thickener suitably constitutes slightly over one-half of the composition of the lubricant, most suitably approx. 60-75%.

Thickener comprises one or more solid additives of a softer material than the metal wires of the rope, and is preferably non-organic. Thickener can contain lithium, lithium complex, calcium, calcium complex, calcium carbonate, gypsum, talcum, calcite, fluorite or apatite, or some other material suited to the purpose, e.g. a compound containing calcium.

The lubricant of the rope contains oil, e.g. gear oil or bearing oil, comprising approx. 15-80%, suitably less than one-half, preferably approx. 20-30% of the mass of the lubricant (8).

The lubricant can also contain binder agents, filler agents and additives. These account for less than 15% of the mass.

The lubricant contains, in addition to oil and thickener, binding agent comprising 0-10% of the mass.

BRIEF DESCRIPTION OF THE DRAWINGS

In the following, the invention will be described in detail by the aid of an example of its embodiment with reference to the attached drawing, wherein.

DETAILED DESCRIPTION

Figure 1:
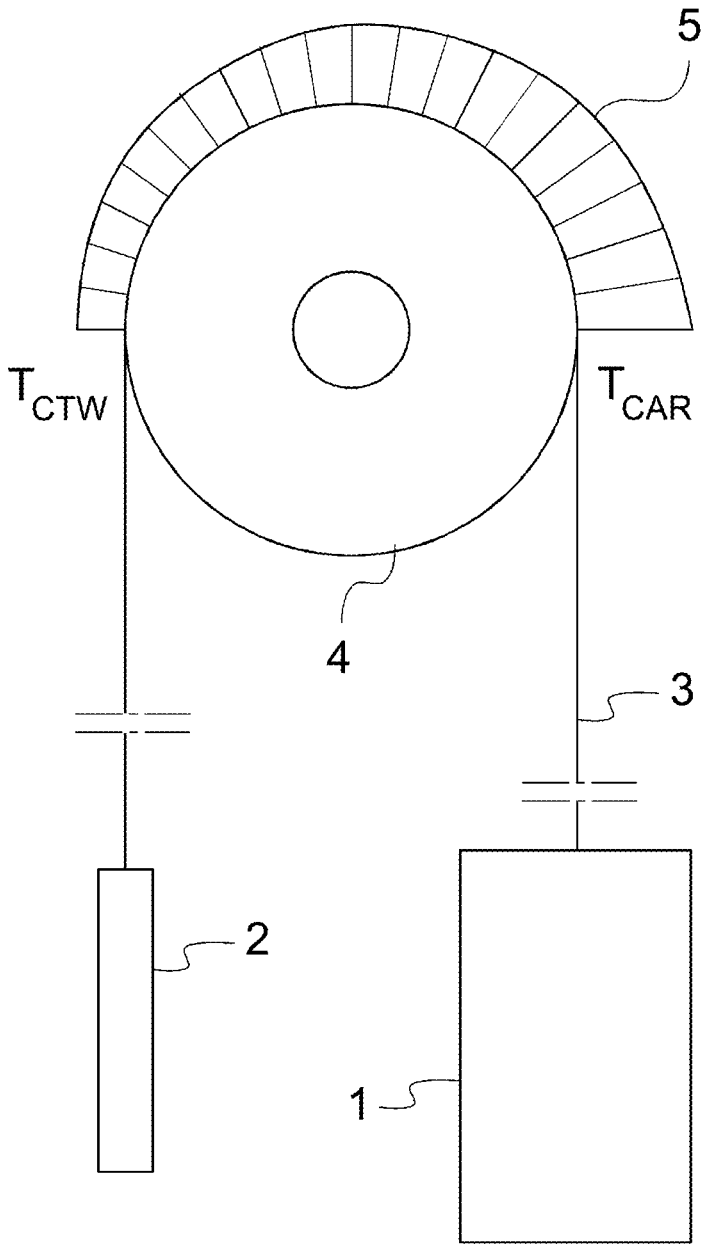
FIG. 1 presents a diagrammatic and simplified view of one traction sheave elevator with its rope tension chart as viewed from the side of the traction sheave.

FIG. 1 presents a diagrammatic and simplified view of one typical traction sheave elevator, which comprises an elevator car 1, a counterweight 2 and, fixed between these, elevator roping formed of elevator ropes 3 that are parallel to each other. The elevator ropes 3 are guided to pass over the traction sheave 4 rotated by the hoisting machine of the elevator in rope grooves dimensioned for the elevator ropes 3. As it rotates, the traction sheave 4 at the same time moves the elevator car 1 and the counterweight 2 in the up direction and down direction, due to friction.

Owing to the difference between the counterweight 2 and the elevator car 1 plus the load at any given time in the car, the rope forces $T_{CTW}$ and $T_{CAR}$ exerted on the elevator ropes 3 are of different magnitudes on different sides of the traction sheave 4. When the elevator car 1 contains less than one-half of the nominal load, the counterweight is generally heavier than the elevator car 1 with load. In this case the rope force $T_{CTW}$ between the counterweight 2 and the traction sheave 4 is greater than the rope force $T_{CAR}$ between the elevator car 1 and the traction sheave 4. Correspondingly, when the elevator car 1 contains over one-half of the nominal load, the counterweight 2 is generally lighter than the elevator car 1 with load. In this case the rope force $T_{CTW}$ between the counterweight 2 and the traction sheave 4 is smaller than the rope force $T_{CAR}$ between the elevator car 1 and the traction sheave 4. In the situation presented in FIG. 1, the rope force between the elevator car 1 and the traction sheave 4 is $T_{CAR}>T_{CTW}$. As a consequence, the rope tension acting on the elevator ropes 3 that is produced by the rope forces $T_{CTW}$ and $T_{CAR}$ in the rope grooves of the traction sheave 4 is not constant, but instead increases when going from the counterweight 2 side to the elevator car 1 side. This growing rope tension is diagrammatically presented in the tension chart 5 drawn in FIG. 1. As explained earlier, this tension difference tries to cause slipping of the elevator ropes 3 in the rope grooves. It is endeavored to compensate for the tension difference across the traction sheave 4 with a controlled slip, which can be implemented e.g. owing to the larger friction.

Figure 2:
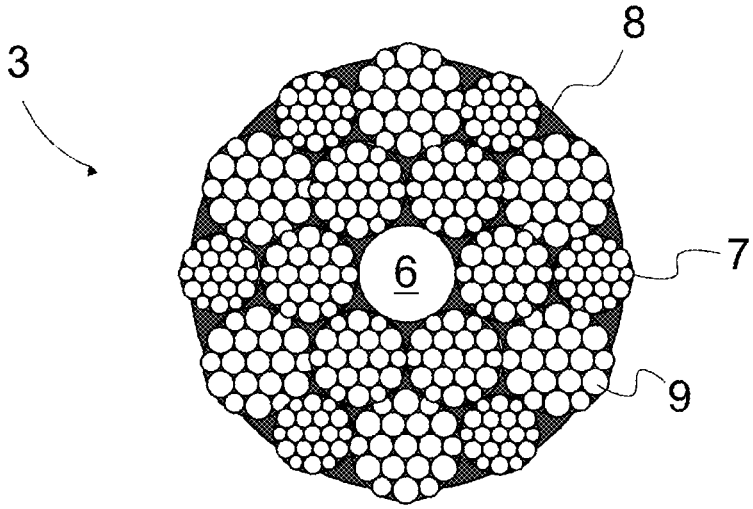
FIG. 2 presents a cross-section of one metal rope, such as a suspension rope of an elevator, lubricated with a lubricant.

FIG. 2 presents a cross-section of one metal rope, such as a suspension rope 3 of an elevator. The suspension rope 3 of the elevator comprises strands 7 laid together around a core 6, which strands for their part are laid e.g. from metal wires, such as from steel wires 9. The elevator rope 3 has been lubricated with lubricant 8 in connection with the manufacture of the rope. Lubricant 8 is between the strands and also between the wires 9 of the strands, and the lubricant 8 is arranged to protect the strands 7 and the wires 9 from rubbing against each other. The lubricant 8 of the elevator rope 3 according to the invention also acts on the friction factor between the elevator rope 3 and the traction sheave 4 of the elevator, increasing the friction compared to elevator ropes lubricated with lubricating oil according to prior art.

The lubricant 8 of a suspension rope 3 of an elevator according to the invention comprises at least some base oil suited to the purpose, some thickener, i.e. solid additive and also if necessary some binder agent. The base oil, more briefly referred to as "oil", is e.g. some suitable synthetic oil that contains various additives, such as e.g. wear resistance agents and corrosion resistance agents. The task of the oil is, among other things, to prevent water from entering the rope 3 and to protect the rope from corrosion and wear. Anti-fretting and possibly also anti-seize types of lubricants are applicable to the purpose according to the invention as a lubricant of an elevator rope 3, even though there are restrictions caused by the application.

Thickener comprises one or more fine-grained solid substances, which are e.g. aluminium-based, lithium-based, barium-based or calcium-based metal soaps. The thickener can also be so-called lithium complex or calcium complex, in which case a number of metal soaps are used together as a thickener. For example, one or more of the following are used as a thickener in the lubricant 8 according to the invention: lithium, lithium complex, calcium, calcium complex, calcium carbonate, gypsum, talcum, calcite, fluorite or apatite, or some other material suited to the purpose, e.g. some other compound containing calcium. The thickener can also be a mixture of some of the aforementioned two or more substances.

Thickener is of softer material than the steel of the steel wires 9, from which the elevator rope 3 is manufactured, which prevents the lubricant 8 wearing off the rope 3 by abrasion. The thickener is also arranged to function as a dry lubricant of the rope 3 and to bind oil. In this case the thickener functions as a material that stores the oil and does not form a solution with the oil.

The binder agent is arranged to keep the other materials of the lubricant 8, i.e. the oil, and the thickener together better. The binder agent is e.g. an organically-based mass, such as a butyl compound or some other substance suited to the purpose, e.g. a resin-based or wax-based substance.

The lubricant 8 is manufactured simply by mechanically mixing its different constituent parts with each other. The mixing ratios of the different constituents of the lubricant 8 are e.g. approx. 15-80%, preferably approx. 20-30%, oil, e.g. approx. 10-85%, preferably approx. 65-75%, thickener, and e.g. approx. 0-10%, suitably approx. 3-6%, e.g. 5%, binder agent. The aforementioned percentage figures are percentages by weight. Owing to the large amount of thickener, the structure of the lubricant 8 is paste-like. With the help of the binder agent and thickener, the lubricant 8 stays on the rope well and does not detach easily.

The lubricant 8 according to the invention differs from conventional lubricating grease in that, among other things, preferably the lubricant comprises a very high proportion of thickener and less oil. The thickener can account for e.g. at most 85%, in which case the proportion of base oil remains at 15% at the highest. Instead of that, with lubricating greases the proportion of base oil in the grease is 80-90%, in which case the proportion of thickener and other substances remains only at 10-20%.

Figure 3:
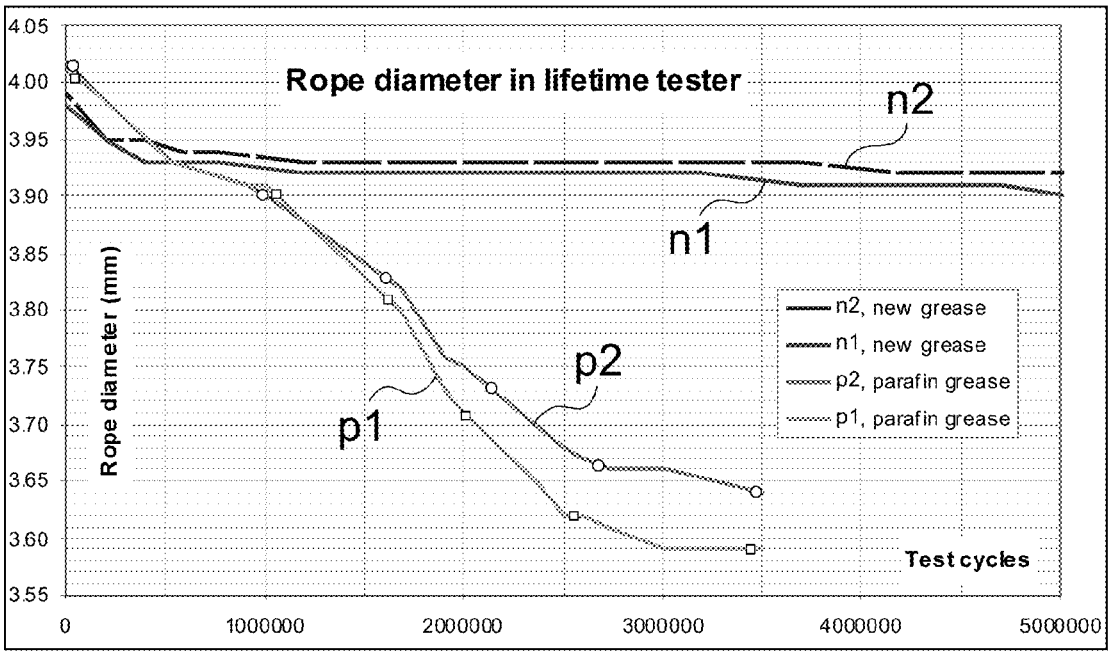
FIG. 3 presents a graph, compiled on the basis of measurement results, of the wearing of elevator ropes lubricated in a different way.

FIG. 3 presents a graph compiled on the basis of the measurement results obtained in tests, of the wearing of elevator ropes lubricated in a different way. The curves p1 and p2 present ropes lubricated with paraffin according to prior art, and the curves n1 and n2 present ropes lubricated with the lubricant 8 according to the invention. The wearing of the ropes was tested with test equipment such that the rope was driven back and forth in a groove of a rope sheave and wearing of the rope was diagnosed from the reduction in diameter of the rope.

It can be seen from FIG. 3 that the ropes p1 and p2 that were originally slightly over 4 mm thick and lubricated with paraffin-based lubricant have thinned after approx. one million test cycles to become 3.9 millimeters thick in their diameter. After 1.5 million test cycles, both the ropes p1 and p2 seem to have essentially lost their fitness for purpose. On the other hand, the ropes n1 and n2 that were lubricated with the lubricant 8 according to the invention have not really worn at all even during the 5 million test cycles shown in FIG. 3.

Figure 4:
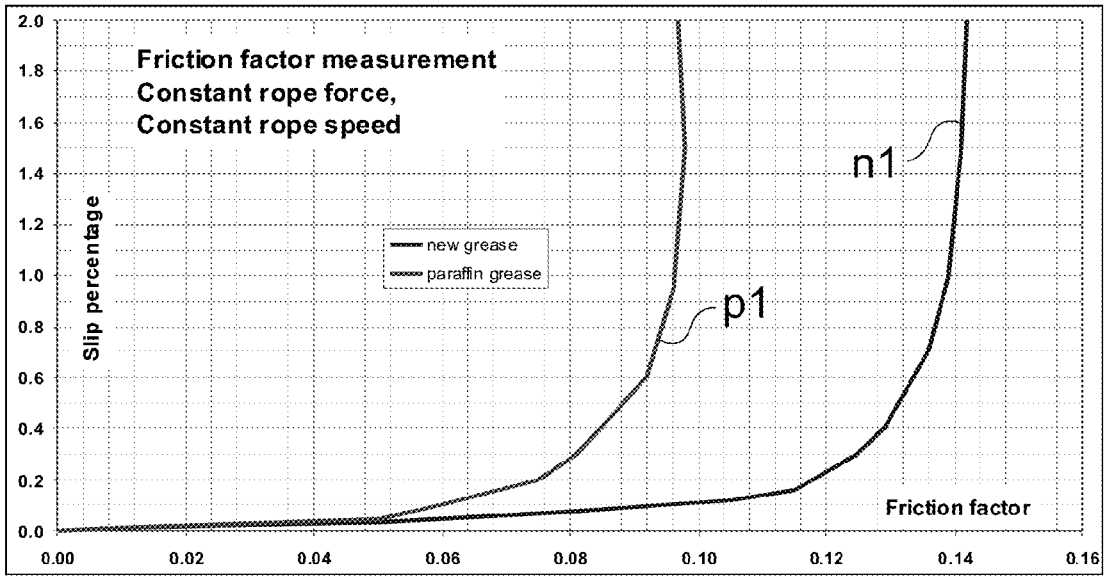
FIG. 4 presents a graph, compiled on the basis of measurement results, of the ratio of the slip percentage of two elevator ropes lubricated in different ways and also of the friction factor between the elevator rope and the rope groove.

FIG. 4 presents a graph, compiled on the basis of the results of measurements made in a laboratory, of the relationship between the friction factor of the rope groove of the traction sheave 4 and the slip percentage of a steel rope p1 lubricated with a paraffin-based lubricant according to prior-art and a steel rope n1 lubricated with the lubricant 8 according to the invention. The case shown here is thus the empirically obtained effective friction factor between two objects that slide against each other, and not the specific friction factor for an individual material.

It can be seen from the graph that in the case of a steel rope lubricated with a paraffin-based lubricant according to prior art, which is represented by the curve p1 in FIG. 4, the effective friction factor rises linearly and relatively sharply in the initial phase of slip. When the slip is approx. 0.3%, the increase in the effective friction factor has slowed down, being in this phase now approx. 0.08. After this when the slip increases, the rise in the effective friction factor slows down even faster and does not increase over the approx. 0.1 limit here, even if the slip were to grow more. In this case, the situation is that the grip of the elevator rope in the groove of the traction sheave 4 has been lost.

Correspondingly, in the case of a steel rope lubricated with the lubricant 8 according to the invention, which is represented by the curve n1 in FIG. 4, the effective friction factor again rises linearly and relatively sharply in the initial phase of slip. As the slip increases, the effective friction factor now also continues its increase, essentially linearly to a higher value of effective friction factor than with the rope represented by the curve p1. With the rope n1 lubricated with the lubricant 8 according to the invention, as the slip increases, the effective friction factor reaches a value of almost 0.14. In this case considerably more grip reserve remains for the traction sheave 4 in case of unexpected situations, and larger values than 0.1, e.g. values approaching 0.14, can be used for the effective friction factor in the dimensioning. This enables a higher ratio $T_{CAR}/T_{CTW}$ of rope forces, in which case it is possible to achieve smaller moving masses, a further consequence of which is smaller acceleration forces, lower energy consumption and smaller losses. In addition, savings can be made in materials.

It is clearly verified by the tests described above that, owing to the high proportion of thickener contained in the lubricant 8, the lifetime of an elevator suspension rope 3 lubricated with the lubricant 8 is considerably longer than the lifetime of elevator ropes lubricated with prior-art lubricants, and in addition the friction factor between the rope 3 and the traction sheave 4 is greater than when using conventional lubricants, which enables more advantageous dimensioning.

One characteristic aspect, among others, of the elevator according to the invention is that the elevator is provided with suspension ropes 3 that are lubricated with a lubricant 8 that contains thickener, the load-bearing material of which ropes is metal, e.g. steel. The thickener in the lubricant of the suspension ropes 3 of the elevator comprises a suitable aforesaid percentage of the whole mass of the lubricant 8. In addition, the lubricant 8 can contain the aforementioned binder agents and other additives.

The use of the aforementioned lubricant 8 that contains thickener for lubricating a rope laid from metal wires is further characteristic for the solution according to the invention.

It is obvious to the person skilled in the art that different embodiments of the invention are not only limited to the examples described above, but that they may be varied within the scope of the claims presented below. Thus, for example, the composition of the lubricant and the mixture ratio of the different constituents can also be different to what is described above.

Likewise it is obvious to the person skilled in the art that instead of synthetic oil, mineral oils or vegetable oils suited to the purpose can also be used as an oil in the lubricant.

It is further obvious to the person skilled in the art that the zinc of the rope wires of a suspension rope, with which the rope wires are coated against corrosion, can also be a thickener, i.e. a necessary solid additive.

The invention claimed is:

1. A traction sheave elevator, comprising:

an elevator car; and a plurality of suspension ropes to move the elevator car, the plurality of suspension ropes passing over a traction sheave having a hoisting machine, and the plurality of suspension ropes being lubricated with a lubricant including at least oil and thickener, the thickener being greater than 15% of the mass of the lubricant.

2. The traction sheave elevator according to claim 1, wherein the thickener includes calcium carbonate, gypsum, talcum, calcite, fluorite or apatite, or a compound containing calcium.

3. The traction sheave elevator according to claim 1, wherein the oil is about 15-70% of the mass of the lubricant.

4. The traction sheave elevator according to claim 1, wherein the lubricant further includes a binding agent, the binding agent being less than or equal to about 10% of the mass of the lubricant.

5. A traction sheave elevator, comprising:

an elevator car; and a plurality of suspension ropes to move the elevator car, the plurality of suspension ropes passing over a traction sheave having a hoisting machine, and the plurality of suspension ropes being lubricated with a lubricant including at least oil and thickener, the thickener being about 30-85% of the mass of the lubricant.

6. The traction sheave elevator of claim 5, wherein the thickener is about 65-75% of the mass of the lubricant.

7. The traction sheave elevator of claim 1, wherein the oil is about 20-30% of the mass of the lubricant.

8. The traction sheave elevator of claim 1, wherein each of the plurality of suspension ropes comprises:

at least one or more strands laid from metal wires.

9. The traction sheave elevator of claim 8, wherein the lubricant further includes one or more solid additives of a material softer than the metal wires.

10. The traction sheave elevator of claim 8, wherein the metal wires are steel wires and the thickener includes one or more solid additives of a material that is softer than the steel wires.

11. The traction sheave elevator of claim 10, wherein the thickener is non-organic.

12. The traction sheave elevator of claim 1, wherein the thickener includes lithium, lithium complex, calcium, calcium complex, calcium carbonate, gypsum, talcum, calcite, fluorite or apatite, or a compound containing calcium.

13. The traction sheave elevator of claim 1, wherein the oil is about 15-80% of the mass of the lubricant.

* * * * *